US009410783B1

(12) United States Patent
Khuc et al.

(10) Patent No.: US 9,410,783 B1
(45) Date of Patent: Aug. 9, 2016

(54) UNIVERSAL SMART FUZE FOR UNMANNED AERIAL VEHICLE OR OTHER REMOTE ARMAMENT SYSTEMS

(71) Applicants: Lloyd Khuc, Wharton, NJ (US); Nicholas Cali, Hopatcong, NJ (US); Daniel Vo, Landing, NJ (US)

(72) Inventors: Lloyd Khuc, Wharton, NJ (US); Nicholas Cali, Hopatcong, NJ (US); Daniel Vo, Landing, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 171 days.

(21) Appl. No.: 14/463,899

(22) Filed: Aug. 20, 2014

Related U.S. Application Data

(63) Continuation-in-part of application No. 13/097,174, filed on Apr. 29, 2011, now abandoned.

(60) Provisional application No. 61/331,412, filed on May 5, 2010.

(51) Int. Cl.
*F42C 15/40* (2006.01)
*F42C 15/00* (2006.01)
*F42C 11/00* (2006.01)

(52) U.S. Cl.
CPC ..... *F42C 15/40* (2013.01); *F42C 11/00* (2013.01)

(58) Field of Classification Search
CPC ..... F42B 12/00; F42B 12/02; F42B 12/20; F42C 11/00; F42C 11/001; F42C 15/00; F42C 15/40; F42C 15/42; F42C 15/44; F42C 21/00
USPC ..... 102/200, 206, 215, 262, 218, 264, 499, 102/396
See application file for complete search history.

(56) References Cited

U.S. PATENT DOCUMENTS 3,739,726 A * 6/1973 Pintell ..... F42C 15/40 102/215
4,064,806 A * 12/1977 Apstein ..... F42C 17/04 102/210
4,541,341 A * 9/1985 Fowler ..... F42C 15/40 102/215
4,586,436 A * 5/1986 Denney ..... F42C 11/065 102/200
4,651,647 A * 3/1987 Baker ..... F42C 13/023 102/213
4,936,187 A * 6/1990 Teeter ..... F42C 15/40 102/221
5,206,455 A * 4/1993 Williams ..... F42B 3/113 102/201
5,344,105 A * 9/1994 Youhanaie ..... F41G 7/346 244/3.14
5,379,966 A * 1/1995 Simeone ..... F41G 7/308 244/3.11

(Continued)

*Primary Examiner* — Jonathan C Weber
(74) *Attorney, Agent, or Firm* — Michael C. Sachs

(57) ABSTRACT

An unmanned aerial vehicle is equipped to carry a payload of explosives for remote delivery upon a target. The vehicle includes a small TV camera, global positioning system, and auto pilot homing target software. The modified vehicle is capable of being detonated upon an impact or selectively while still in flight. Vehicle flight is monitored by an operation person at a ground control station. The vehicle includes universal smart fuze circuitry for enabling the multiple functions for the vehicle and for enabling communications/commands from the operator at the ground control station. The fuze continuously communicates aspects of fuze status back to the ground control station; measures flight velocity by sensing air speed of the UAV; arms/disarms an explosives warhead package in the vehicle; in flight fires the explosives or else detonates the explosives warhead package upon impact with a select target. The camera images are communicated back to the operator who can make a decision on completing/aborting a mission. The wind speed indications, also fed back to the operator, can further aid in verifying a successful launch/good flight for decision of completing/aborting a mission.

12 Claims, 13 Drawing Sheets

(56) References Cited

U.S. PATENT DOCUMENTS 5,443,227 A * 8/1995 Hsu ..... H04J 14/0298 244/3.12
5,458,041 A * 10/1995 Sun ..... F41G 7/00 244/3.11
5,511,218 A * 4/1996 Castelaz ..... F41G 3/04 718/102
5,521,817 A * 5/1996 Burdoin ..... G05D 1/0027 244/190
5,554,994 A * 9/1996 Schneider ..... F41G 7/346 244/3.19
5,708,230 A * 1/1998 Woodall, Jr. ..... B60V 1/043 102/402
5,855,339 A * 1/1999 Mead ..... F41G 7/308 244/3.11
6,037,899 A * 3/2000 Weber ..... F41G 3/142 244/3.2
6,155,155 A * 12/2000 Moshier ..... F41B 3/04 102/211
6,295,932 B1 * 10/2001 Kane, III ..... F42C 15/40 102/215
7,422,175 B1 * 9/2008 Bobinchak ..... F41G 3/04 244/3.1
7,631,833 B1 * 12/2009 Ghaleb ..... F41G 7/2233 102/382
8,543,255 B2 * 9/2013 Wood ..... G05D 1/0027 701/2
2003/0075069 A1 * 4/2003 Boucher ..... B60R 21/017 102/217
2004/0088112 A1 * 5/2004 Dirks ..... F42C 15/40 701/468
2011/0017864 A1 * 1/2011 Roemerman ..... F42B 10/64 244/3.16
2012/0175459 A1 * 7/2012 Geswender ..... F42B 10/26 244/3.24

* cited by examiner

UNIVERSAL SMART FUZE FOR UNMANNED AERIAL VEHICLE OR OTHER REMOTE ARMAMENT SYSTEMS

CROSS REFERENCE TO RELATED APPLICATIONS

This application is a continuation in part of U.S. patent application Ser. No. 13/097,174 filed Apr. 29, 2011 by identical inventors Lloyd Khuc et al., entitled "Universal Smart Fuze For Unmanned Aerial Vehicle Or Other Remote Armament Systems", which in turn claimed benefit under 35 USC §119 of the filing date of U.S. Provisional Patent Application No. 61/331,412 filed May 5, 2010, the entire file contents of all of which applications are incorporated herein as though fully set forth. In addition, this application fully incorporates by reference the entire contents of U.S. Pat. No. 7,631,833 issued Dec. 15, 2009 to Ghaleb et al., entitled "Smart Counter Asymmetric Threat Micromunition With Autonomous Target Selection And Homing".

U.S. GOVERNMENT INTEREST

The inventions described herein may be made, used, or licensed by or for the U. S. Government for U. S. Government purposes.

BACKGROUND OF INVENTION

Currently, there are very few Man-Portable Unmanned Aerial Vehicles (UAV) that can effectively identify and neutralize light-armored targets or Improvised Explosive Devices (IED) with energetic warheads while minimizing collateral damage. The lack of such tactical capabilities constrains the warfighter's ability to function in an urban environment where the targets might be in areas where the potential for civilian casualties is relative high. This Lethal UAV program is a first step toward achieving a solution to such needs.

In current combat methods, Remote Robot Systems (RRS) may be fielded to various degrees to replace humans for surveillance, reconnaissance or patrol operations in hostile areas. Armed Forces utilize many RRS types with cameras that, each or together, are capable of identifying hostile targets. However, currently such RSS systems are not equipped to then also eliminate such dangerous targets. Often then, human soldiers must still put their lives at risk to destroy these targets after the targets have been identified by RRS or by drones. This remains as a great risk to human life. Therefore, there is a strong demand for a lethal drone that, during the same mission can both identify a hostile target and also then be activated to attack for aim of defeating that target. There is also a need to decrease total response time for attempting to destroy such targets through such RSS systems, and also to meet safety requirements.

BRIEF SUMMARY OF INVENTION

These and other objectives may be attained by this invention which aims to adapt a Remote Armament System (RAS) to also attack an urban warfare target after first conducting reconnaissance and identifying such a target. The target can be effectively identified, targeted and neutralized by a small RAS equipped with energetic warhead(s). In such a platform the RAS is used, for example, to remotely destroy an improvised explosive device (IED). A Universal Smart Fuze (USF) is provided in a now lethal Unmanned Aircraft Vehicle (UAV) for functioning such proposed warhead. The USF (and UAV) are controlled by a human operator, at a ground control station. The USF also meets safety requirements for such a lethal UAV. The USF technology includes a smart electronic fuze with multiple safety features. The USF is integrated with the UAV platform avionics to more simply be able to relay information back and forth from the UAV to a UAV Ground Control Station (GCS) for automatic or command function of such lethal UAV warhead. The unmanned aerial vehicle (UAV) may have an air speed sensor, a small camera, a GPS system, and auto pilot homing target software. A UAV used here was about three feet long, with three foot wingspan; the UAV had a range of 1.2 hours; speed of about 30-45 nautical miles per hour, and was launched on a rail through air pressure. The UAV had a lithium polymer rechargeable battery pack. The UAV avionics utilized a Piccolo light autopilot and a 900 MHZ radio; The UAV camera was a color analog 2.4 GHZ video transmitter. The UAV could carry a 0.5 to 3 pound explosive warhead such as C-4 explosive (or a fragmentation warhead) in a space about 1 inch by 4.25 inches set off 8 inches from the nose of the UAV. This USF may also be adapted and applied to many lethal RAS applications where there is a similar need to integrate and to function an explosive warhead.

OBJECTS OF THE INVENTION

It is therefore an object of the present invention to equip an unmanned aerial vehicle to carry a payload of explosives capable of being detonated upon impacting a selected target, or otherwise detonated while in flight.

It is another object of the invention to provide means for an unmanned aerial vehicle flight to be monitored and controlled by an operator at a ground control station.

It is still a further object of the invention to provide communicated images from an on board camera on an unmanned aerial vehicle to help an operator ascertain if a select target is an improvised explosive device (IED), or an enemy fortification.

It is yet another object of the invention to provide circuit fuze means for an operator to remotely determine safe launch, good flight, ascertain wind conditions, also to remotely arm/disarm an unmanned aerial vehicle, to fire its explosives, or to have the unmanned aerial vehicle successfully reach a select target.

These and other objects, features and advantages of the invention will become more apparent in view of the within detailed descriptions of the invention and in light of the following drawings. It should be understood that the sizes and shapes of the different components in the figures may not be in exact proportion and are shown here for visual clarity and for purposes of explanation.

DETAILED DESCRIPTION OF THE INVENTION

Figure 1:
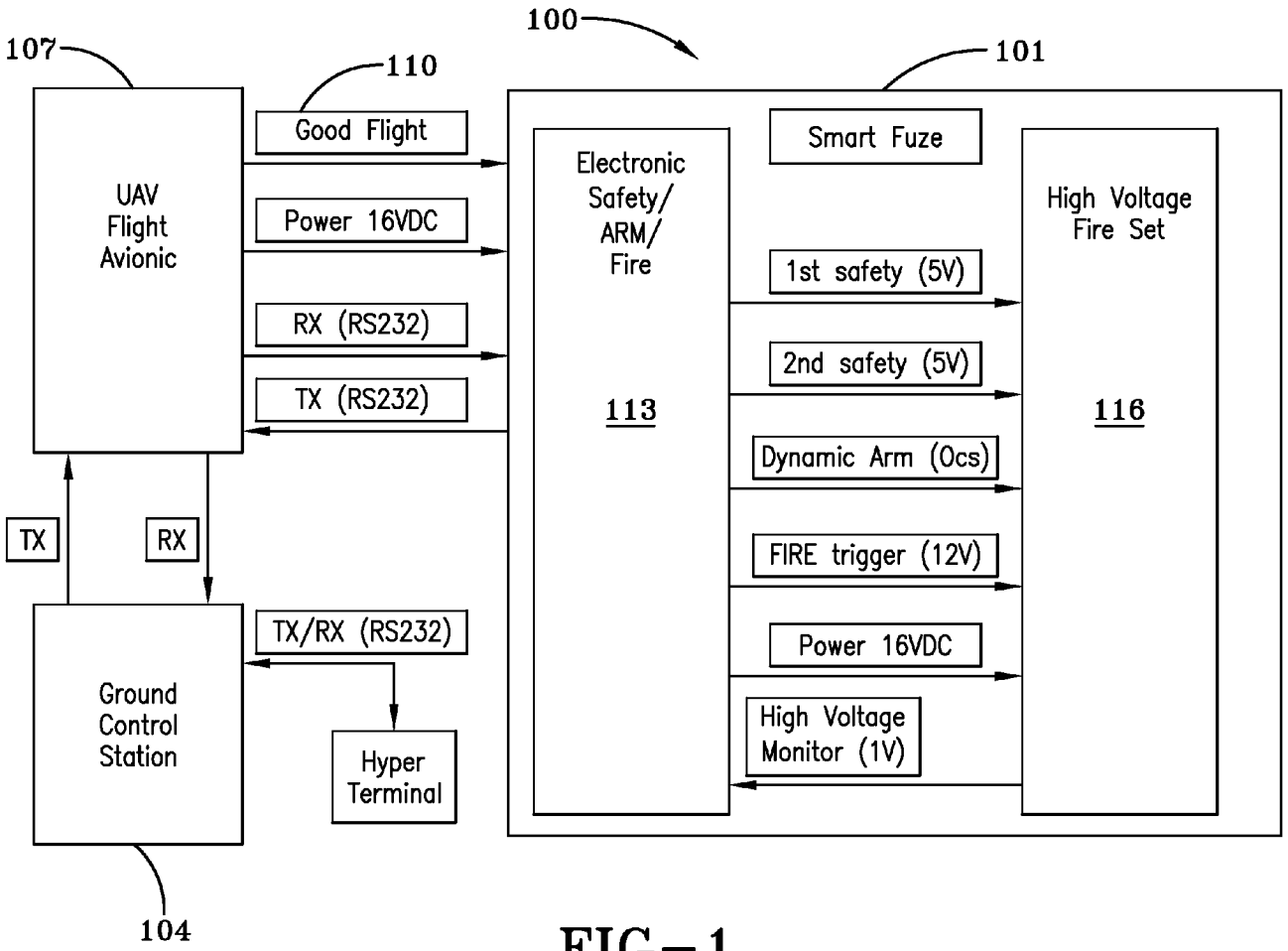
FIG. 1 shows a block diagram of a Universal Smart Fuze and an unmanned aerial vehicle avionic algorithm of a system according to the invention.
Figure 2:
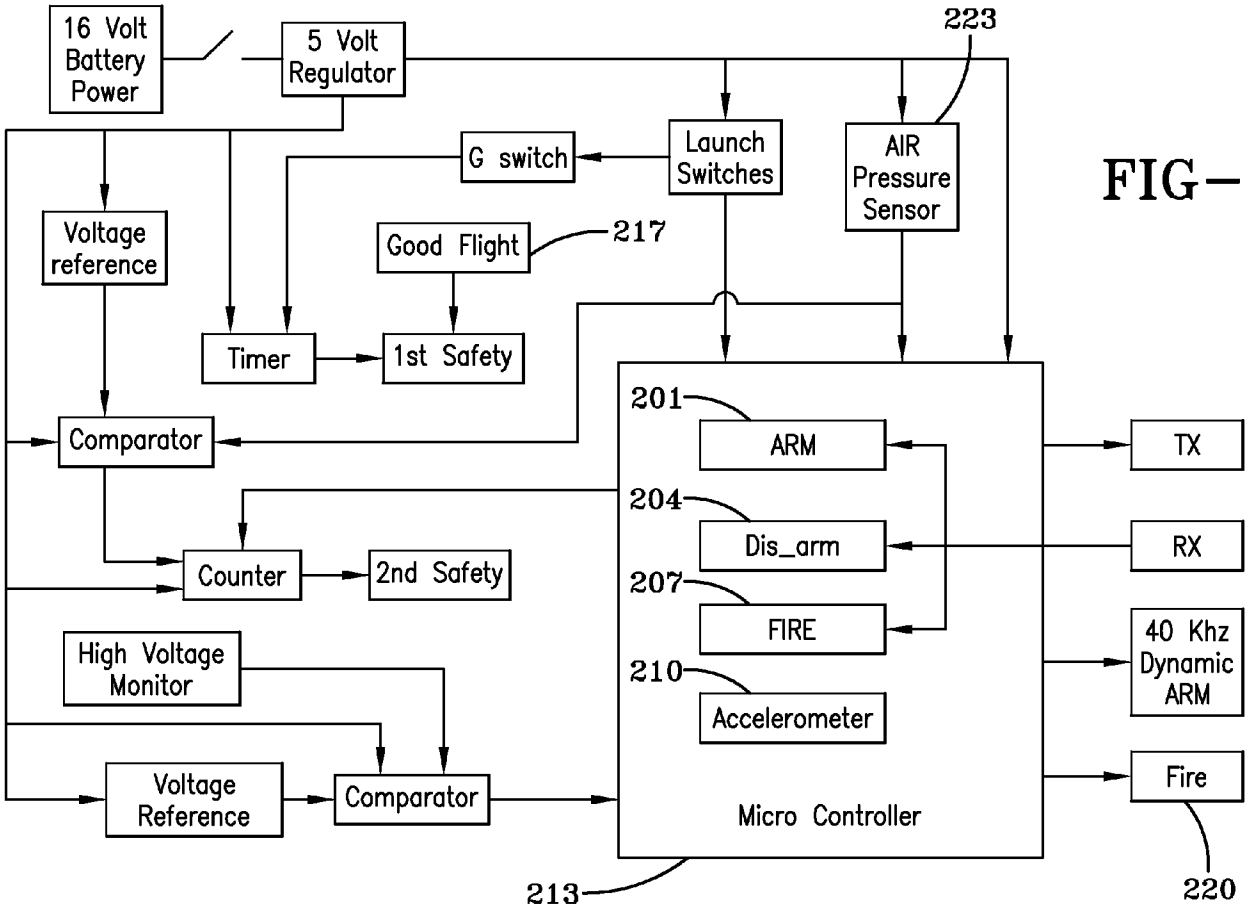
FIG. 2 shows a block diagram of an Electronic Safe/Arm/Fire circuit algorithm of a system according to the invention.
Figure 3:
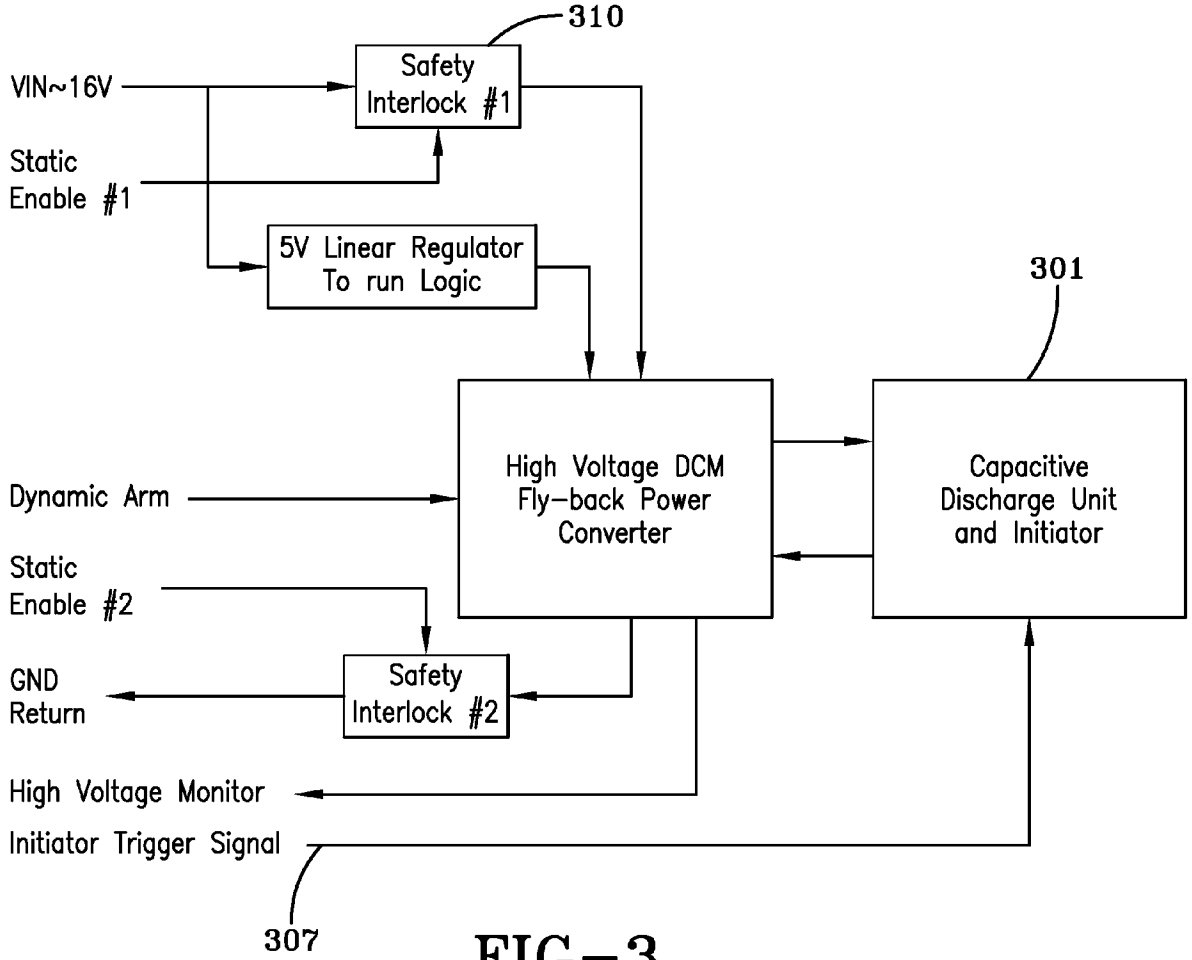
FIG. 3 shows a block diagram of a High Voltage Fire Set circuit algorithm of a system according to the invention.
Figure 4:
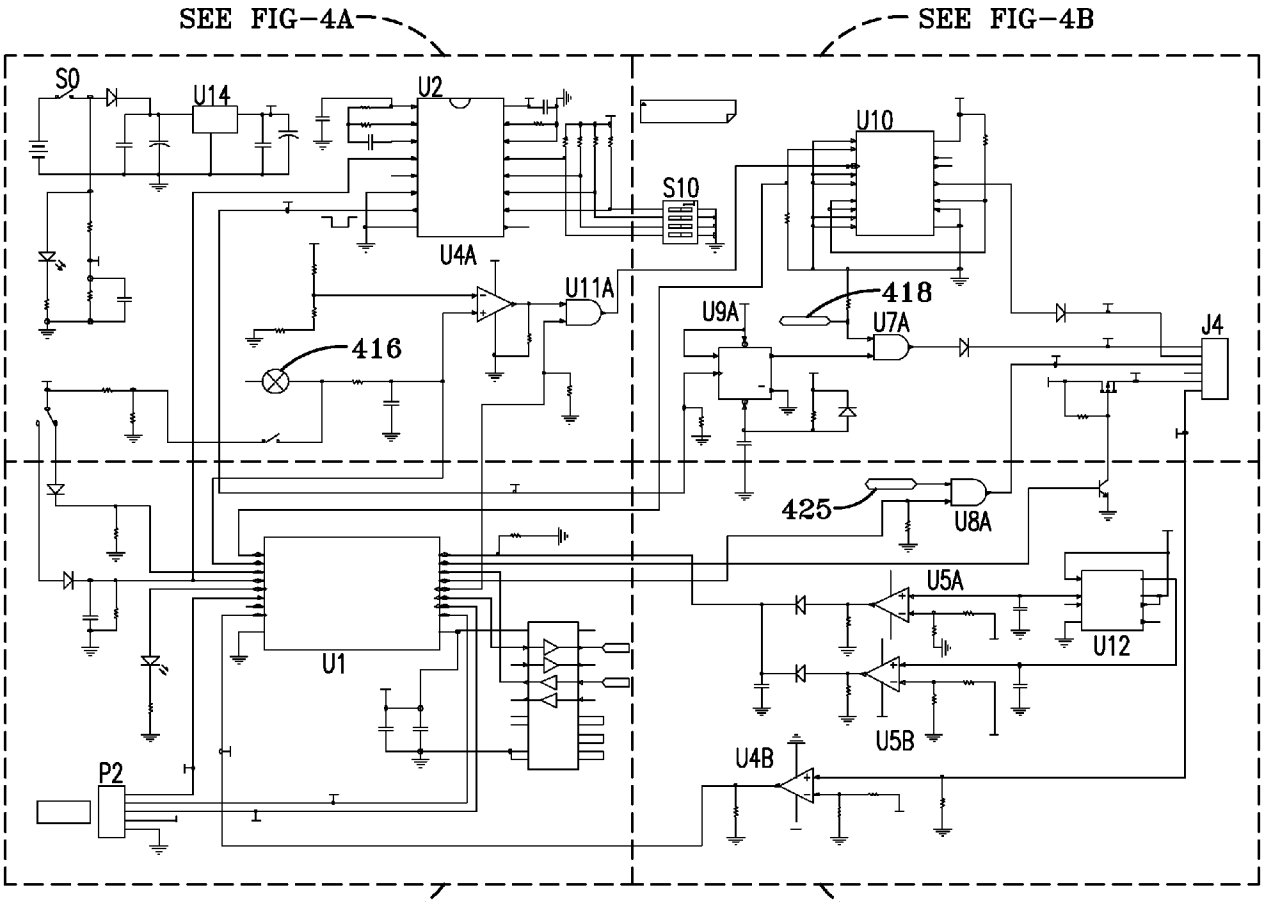
FIG. 4 (which is comprised of sections FIG. 4A, FIG. 4B, FIG. 4C and FIG. 4D) shows a schematic diagram of the Electronic Safe/Arm/Fire circuit portion of a system according to the invention.
Figure 4A:
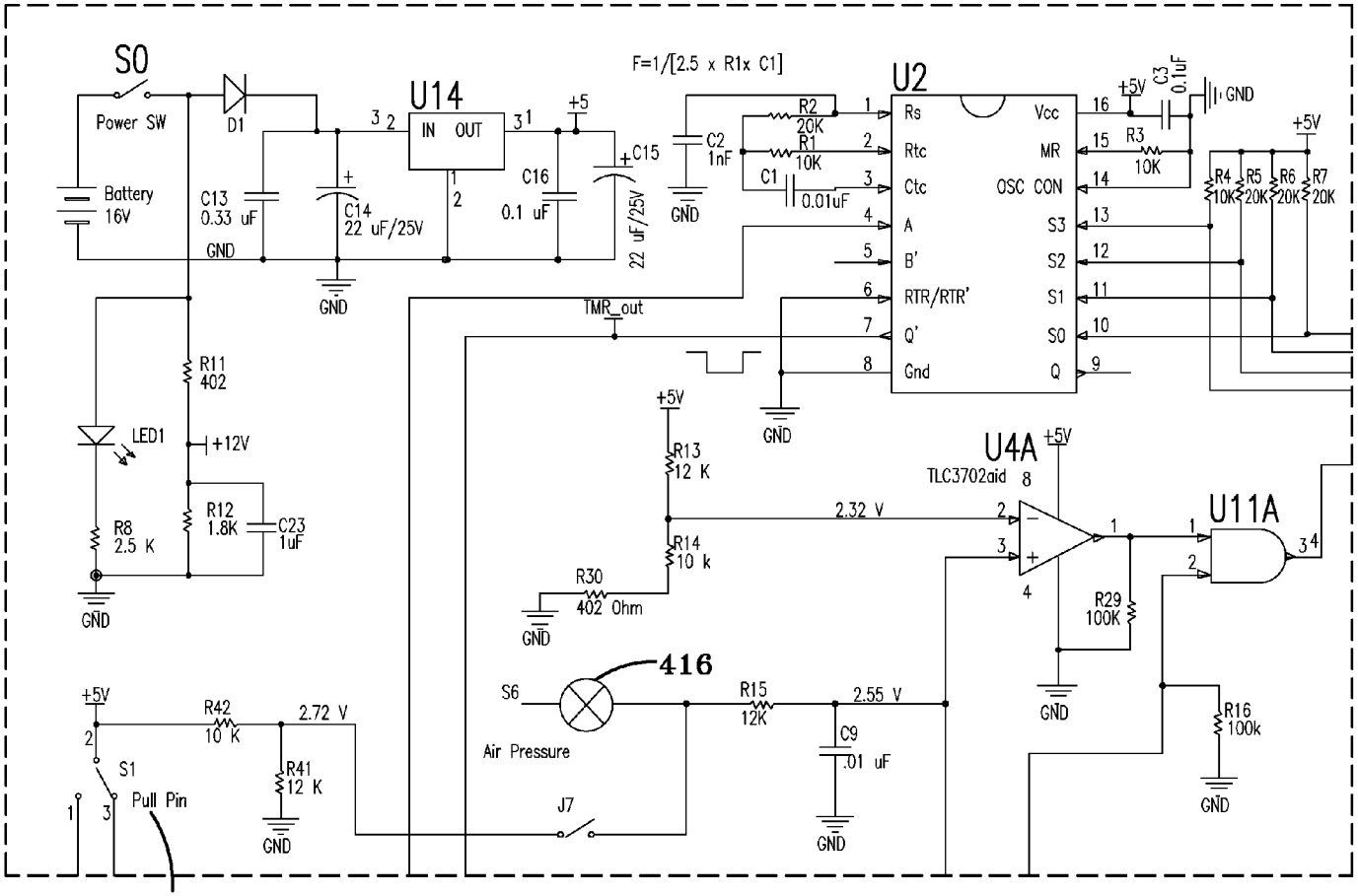
Figure 4B:
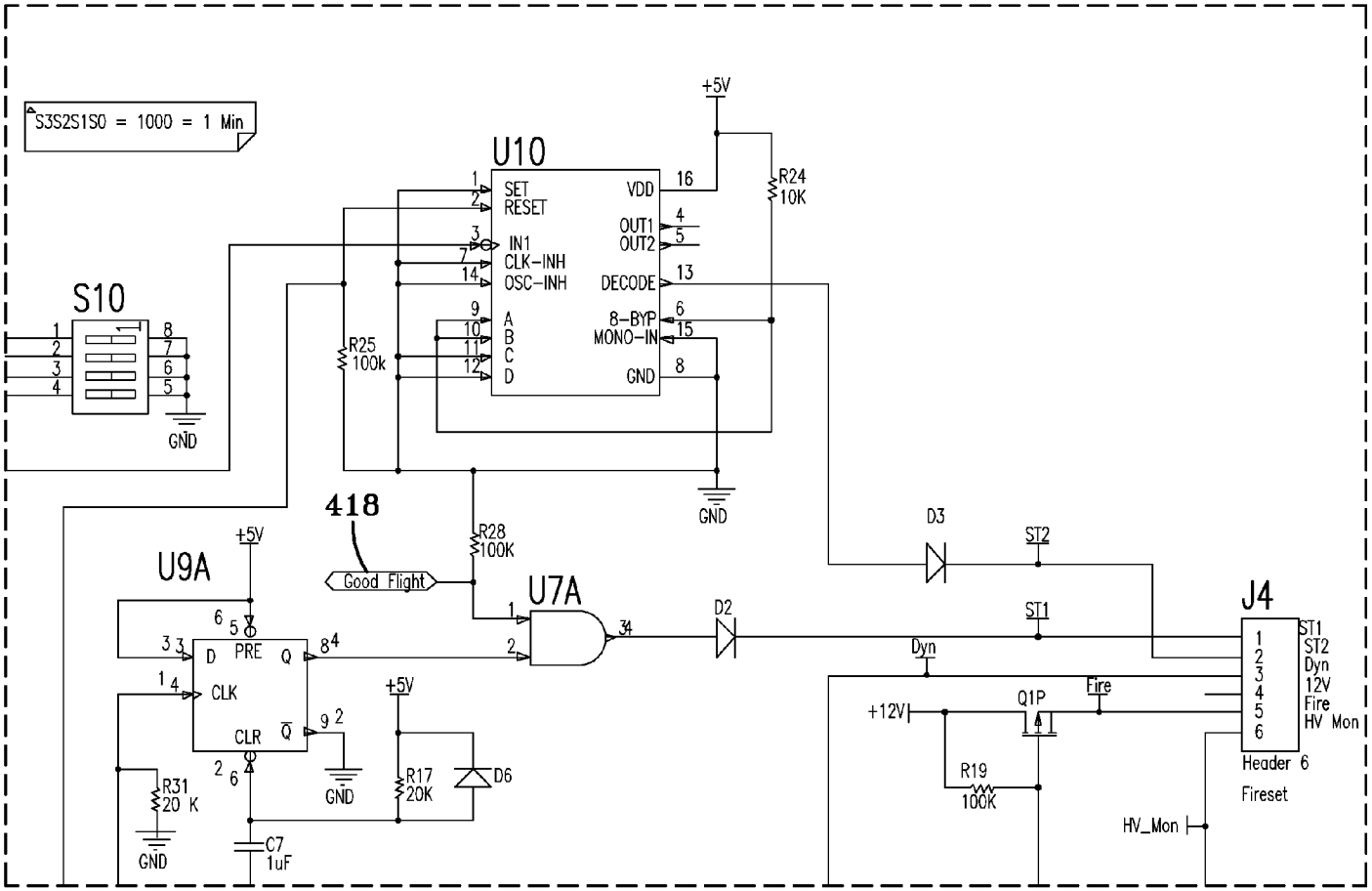
Figure 4C:
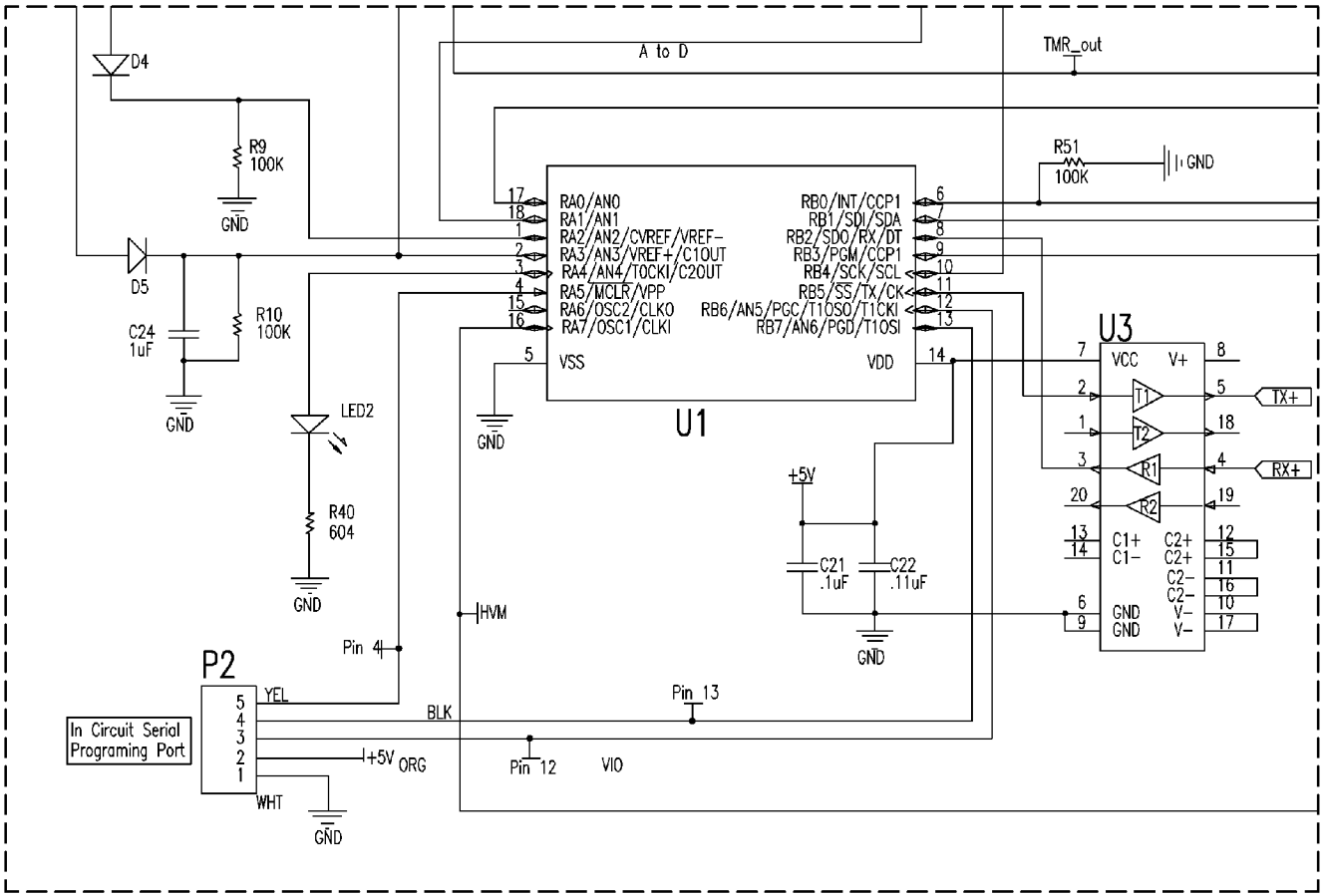
Figure 4D:
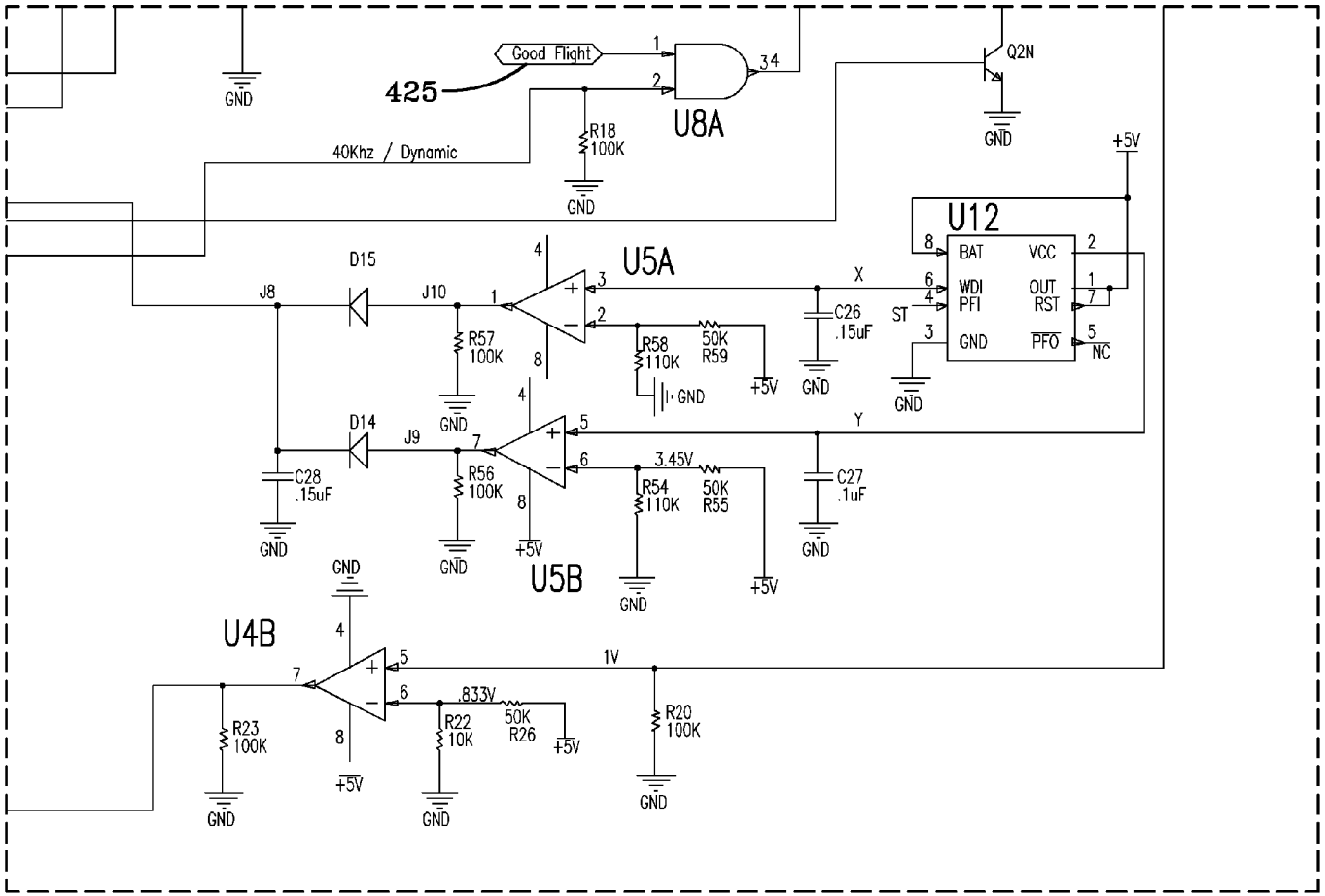
Figure 5:
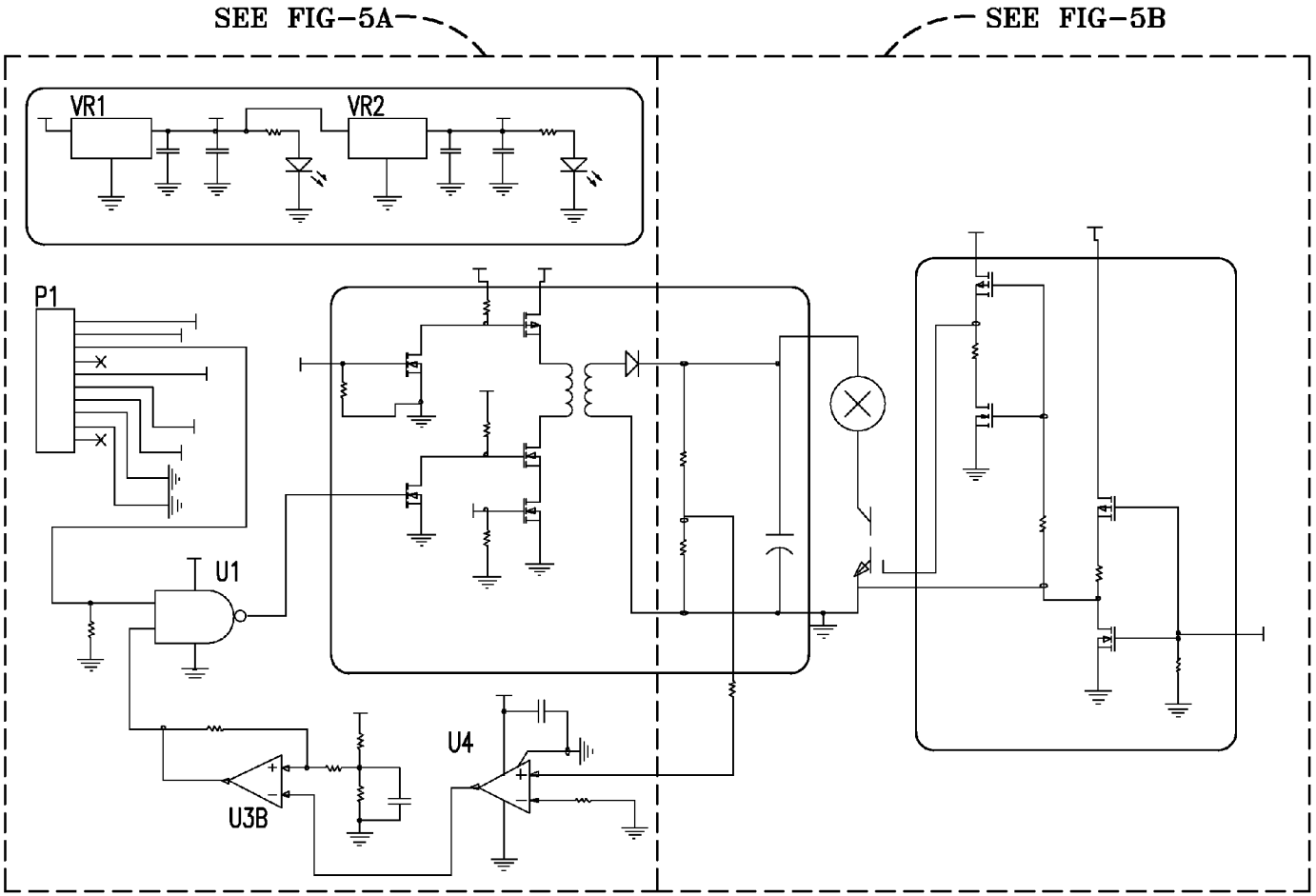
FIG. 5 (which is comprised of sections FIG. 5A and FIG. 5B) shows a schematic diagram of the High Voltage Fire Set circuit portion of the new system according to the invention.
Figure 5A:
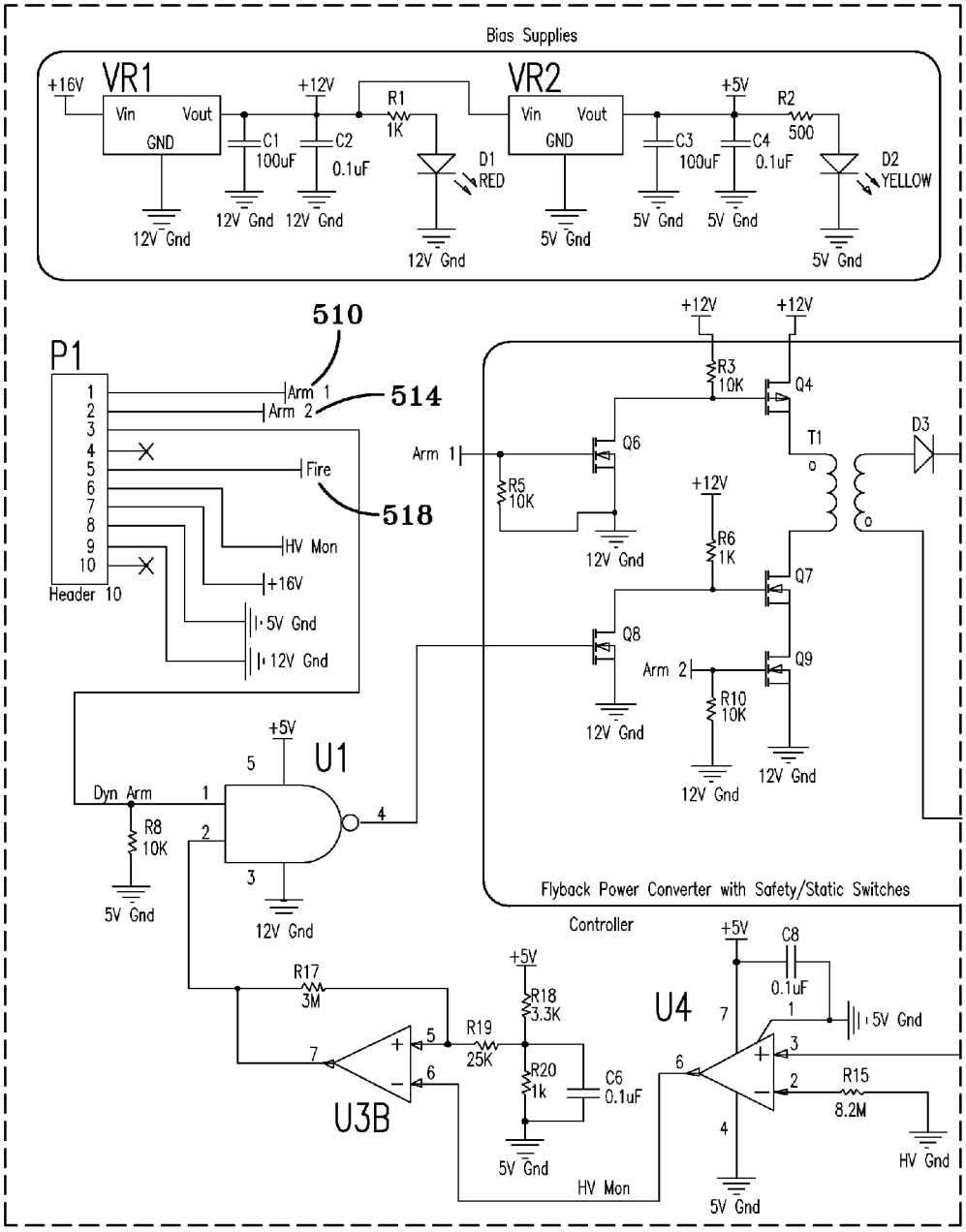
Figure 5B:
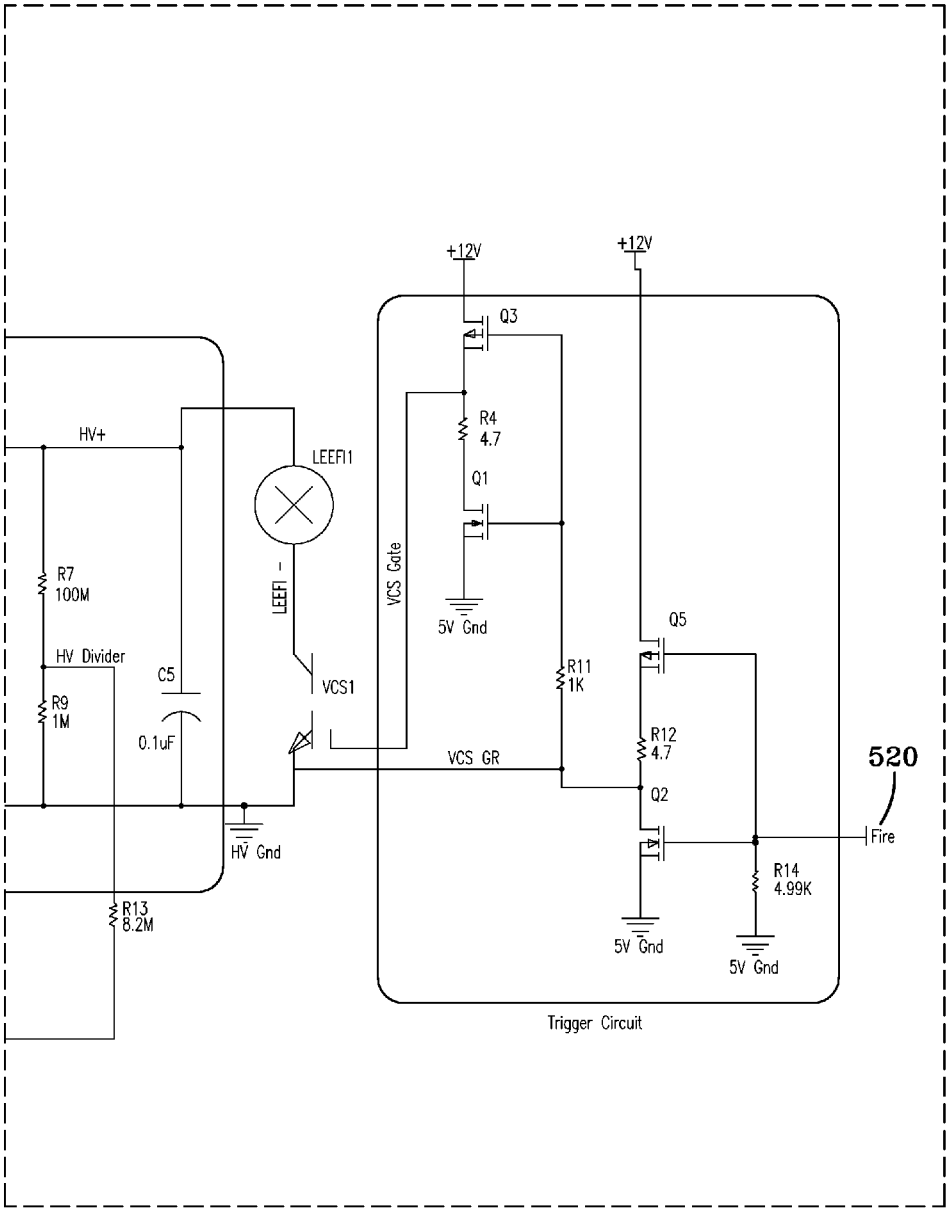
Figure 6:
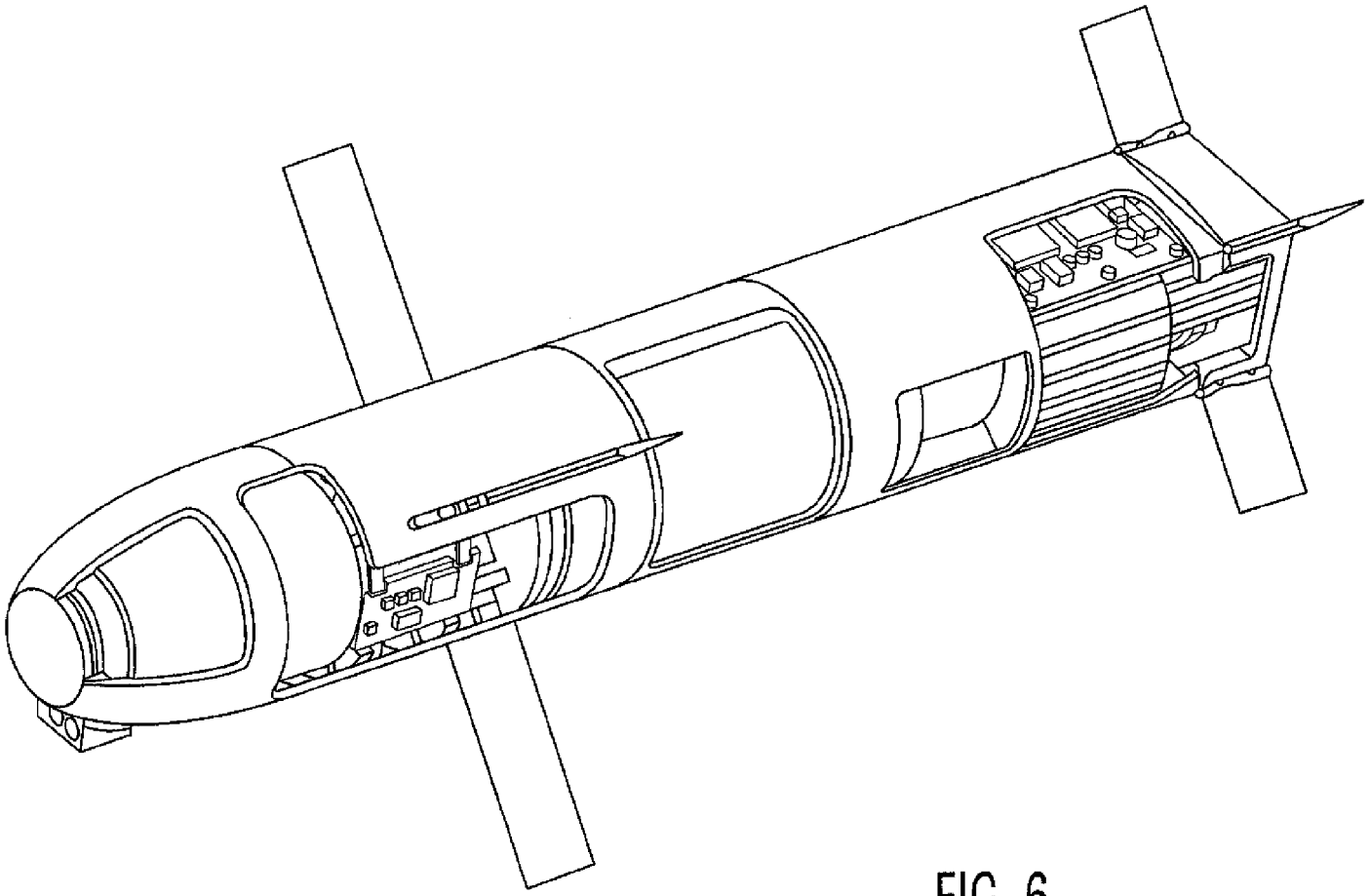
FIG. 6 shows an unmanned aerial vehicle.
Figure 7:
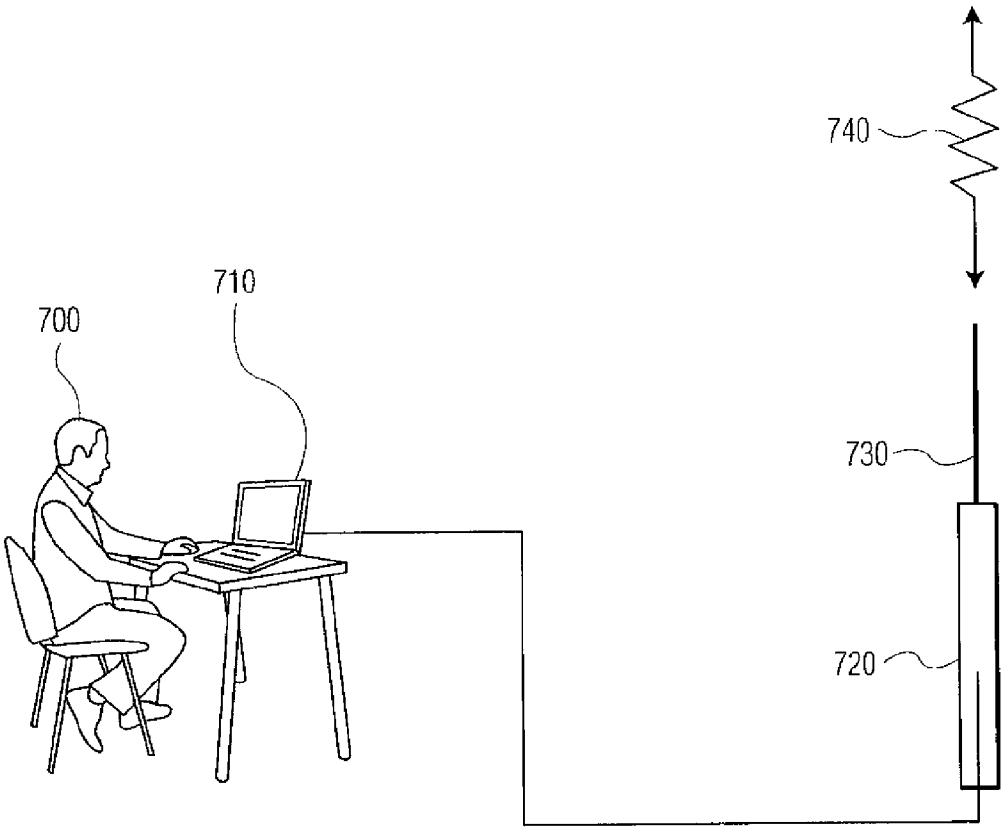
FIG. 7 shows hypothetically a generalized ground processor unit 710 operated by a human operator 700, generating generalized signals 740 over a hypothetical antenna 730 (with aid of generalized telemetry 720) and also receiving signals over the antenna for communication, to control for example an unmanned aerial vehicle in a real time environment.

FIG. 6 shows generically an unmanned aerial vehicle, while FIG. 7 shows hypothetically a generalized ground processor unit 710 operated by a human operator 700, generating generalized signals 740 over a hypothetical antenna 730 (with aid of generalized telemetry 720) and also receiving signals over the antenna for communication, to control for example an unmanned aerial vehicle in a real time environment. FIGS. 1-3 help illustrate desired operation of the UAV of this invention in block diagram form. FIG. 4 (which is comprised of sections FIG. 4A, FIG. 4B, FIG. 4C and FIG. 4D) shows a schematic diagram of the Electronic Safe/Arm/Fire (ESAF) circuit portion of the new system according to the invention, and FIG. 5 (which is comprised of sections FIG. 5A and FIG. 5B) shows a schematic diagram of the High Voltage Fire Set (HVFS) circuit portion of the new system according to the invention.

The following explanations are offered for certain sections of the Fuze shown in the schematics, as will follow.

Item 104, a ground control station (GCS) is a computer based display station, (a suitable model could comprise the 'Cloud Cap Technology Ground Station'). The GCS is responsible for managing the wireless link to one or more Flight Avionics (107), sampling the manual pilot console, supplying different GPS corrections to the avionics, and serving as a bridge to our operator interface. The operator uses the GCS to remotely control our Unmanned Aerial Vehicle (UAV). The GCS is also used to send commands to ARM and FIRE the ammunition warhead mounted at the front of the UAV. The GCS's monitor displays control information and receives status information sent by the UAV. This GCS graphically displays important information such as UAV air speed, UAV location, distance to the target, and the status of the electronic fuze such as: ARM/Disarm, signal-Safety Interlock #1 ON/OFF, and signal-Safety Interlock #2 ON/OFF.

Item107, our UAV Flight Avionics comprise a computer based hardware installed on the UAV (a suitable model could be a 'Piccolo' LT Avionic). Data is wirelessly transmitted between the GCS and our UAV Flight Avionic. The UAV Flight Avionic receives commands from the Ground Control Station which, for example: control the UAV to turn left/right, increase motor speed, go up or down, or ARM/Disarm the fuze ammunition warhead. The UAV Flight Avionic also sends status of the UAV back to the Ground Control Station such as: air speed, aircraft location, remaining battery life, and the Fuze's status.

In micro controller 213, item 201—"ARM" is a command the operator can transmit to the UAV Flight Avionic using the GCS. The UAV Flight Avionic will pass this command to the fuze (101). The Fuze in response will generate firing energy (this is known as "arming" the Fuze) and store it on a device known as a capacitor. When the Fuze is armed, it is ready to detonate the ammunition warhead. When the UAV hits the target, the Fuze will send the signal "FIRE" to a High Voltage circuit, which in turn triggers the release of the firing energy into a detonator which initiates the warhead to explode. The explosive wave front from the detonator propagates to the warhead causing it to explode onto the target. Item 220—Fire is an internal signal within the Fuze used to trigger the electronic switch that releases the firing energy. The firing energy is release into the detonator causing it to explode.

Item 307 illustrates the initiator trigger signal which is a command the operator may send to the Fuze via the GCS. When the fuze receives this command, it safely discharges the high energy capacitor to disarm the fuze and return it to a safe state, without exploding the warhead. The operator can use this command to abort the UAV mission, for a safe recovery.

Item 310—Safety Interlock #1, is one of two static safety switches which may prevent the high energy capacitor from generating firing energy. If either of these two safety switches is not in the 'on' position, then the high energy capacitor will never be able to charge. This would maintain the Fuze in a safe state. (A suitable device for interlock 310 might be an NXP Semiconductor Timer model 74HCT5555).

Item 510 illustrates a connection detail for circuit 310. "ARM-1" shows a signal that polls Safety Interlock #1 (item 310), determining whether it is on or off, and the "ARM-1" signal is generated as a result of the fuze thereby detecting certain valid flight environments.

Item 514 illustrates another connection detail for circuit 310. "ARM-2" is a signal that controls Safety Interlock #2, (referenced on FIG. 3), determining whether it is on or off. ARM-2 is generated as a result of the fuze detecting other various valid flight environments. ARM-2 is associated with a suitable device, semiconductor model MC14536BDW, and is a signal thereon.

Item 518 illustrates a connection detail leading inside the circuitry referenced by top level block 220. "Fire" is an internal signal within the fuze used to trigger the electronic switch that releases the (previously mentioned) "firing energy". (The firing energy is released into a detonator which in turn initiates the warhead to explode).

The following describes examples of some of the human operator control of this UAV at a ground processor station. To launch the UAV, the operator would do the following. The operator first applies the power to turn on the UAV's motor and electronics. The operator would then remove the safety pull pin under the UAV to make the UAV Fuze software start operating. The operator would then launch the UAV. After the UAV launches, the Fuze Timer circuit will set the Safety Interlock #1 (ARM-1) signal on. After 40 seconds of flight, the UAV starts sampling the UAV's air speed and then sends this status back to operator at the Ground Control Station (GCS). The operator monitors the air speed display on the GCS monitor; if the air speed is too slow he will abort the UAV mission. If so, the operator sends an abort command to the Flight Avionic then UAV Flight Avionic will pass this command to the fuze to turn off all the electronic circuits and bring the UAV back to base. If the air speed were good, then the fuze will set the Safety Interlock #2 (ARM-2) signal on and send status back to GCS. The operator will continue to control the UAV flight following the patrol path and using the UAV's camera to send back video. The video is displayed on the GCS monitor to survey the landscape. If the operator sees a valid target; the operator will send the "ARM" command to the fuze through the GCS. When the Fuze completed generating its firing energy, it will send the status back the GCS to let the operator know that the fuze is "ARMed" and ready to initiate firing the explosive. Now the operator will control the UAV to hone in on the target by using automatic GPS guidance or manually controlled by a joy stick.

For automatic mode, the Lethal UAV has the sensor to detect the target impact then send information to the fuze circuit. The fuze will turn on the signal "FIRE" to trigger the electronic switch that releases the firing energy. The firing energy is released into a detonator causing the warhead to explode.

For the manual mode; by watching the video sent back from the UAV the operator can send the command "FIRE" to the UAV Flight Avionic. The UAV Flight Avionic will pass this command to the fuze; the fuze will turn on the signal "FIRE" used to trigger the electronic switch that releases firing energy. The firing energy is released into a detonator causing the warhead to explode.

For any reason after the fuze was "ARMed" and the UAV mission is aborted, the operator can send command "Disarm" to the UAV Flight Avionic. Then the UAV Flight Avionics will pass this command to the fuze; the fuze will turn off all the electronic signals and safely discharge the high energy capacitor. The Fuze will then send its status to the Ground Control Station, which allows the operator to confirm that it has "Disarmed".

Our Lethal UAV can be used for a non-lethal mission by using the camera for patrol, surveillance, reconnaissance. If the operator identifies any interesting targets, the operator can send the command "ARM" to the fuze and guide the UAV to destroy the target.

By way of further detail, the operation of the Universal Smart Fuze 101 comprises an Electronic Safe/Arm/Fire (ESAF) circuit (113), a High Voltage Fire Set (HVFS) circuit (116) and software algorithm. If ready to launch, the operations would include as follows: After the UAV's power supply is turned on, the microcontroller 213 (MC) U1 checks if switch S1 is normally closed, which equals digital logic "1"; if switch S3 is normally open, which equals digital logic "0"; if the High Voltage Monitor (HVM) equals digital logic "0", and if the Air Pressure Sensor 223 (APS) equals digital logic"0". If these are found to be correct: the MC transmits an American National Standards Institute (ANSI) letter data "a" and "A" to the Ground Control Station (GCS) to notify it that the fuze circuit is accurate and that the UAV is ready for launch if desired.

Before the UAV is launched, the operator pulls a safety pin switch (see 408). The Timer Integration Circuit (IC) U2 on the ESAF will then run for 40 seconds, which will then automatically set the first environmental safety (ST1) signal to a digital logic "1" level.

After the UAV is launched; a good launch must be verified. The microcontroller (MC) checks the switch S1 equal to digital logic "0" and S2 equal to digital logic "1"; if those are correct, the microcontroller activates the software to run 50 seconds time delay, then the microcontroller starts sampling the air speed of the UAV (see 416). If the UAV air speed measured does not exceed 30 miles per hour, the MC turns off all the digital logic signals, and stops the software operations; the whole USF fuze circuit would thus be deactivated. If the UAV speed does exceed 30 miles per hour, then the MC transmits an ANSI letter, data "h" and "B" to the Ground Control Station (GCS) to notify it that the UAV had a successful launch. If such, then the MC sets the second environmental safety ST2 signal to a digital logic "1" level. In response, the UAV operator will then set the "Good Flight" 217 signal to a digital logic "1" level on the ground control station (GCS). The GCS will transmit such Good Flight indication signal (see 418, 425) to the ESAF circuit to enable it to then gate out the environmental safety signals.

While the UAV is still in flight, the UAV operator now can arm the UAV by entering ANSI letter, data "m", for "Arm Command", onto the hyper terminal personal computer (PC). The GCS will transmit such Arm command to the ESAF circuit. The ESAF circuit will check if such Arm command matches the one that is hard coded on the MC software. If the Arm command does not match, the ESAF circuit echoes this data back to the GCS, and simply waits for another/new command. If the Arm command does match, then the EASF circuit creates a 40 kilohertz dynamic signal to charge the High Voltage Capacitor 301 on the HVFS board. When this capacitor is charged up to 1,200 Volts, the HVFS board sends a 1 volt signal to the ESAF board. The ESAF board will detect such signal and transmit ANSI letter, data "m", back to the GCS, to notify the operator that the Fuze is now armed.

After arming as described above, the UAV operator has two choices, to detonate or to deactivate arming. For detonation, the operator may enter ANSI letter, data "g", on the hyper terminal PC for a "Fire" command. If done, then the ESAF circuit will check if the Fire command matches the one that is hard coded on the MC software. If it matches, then the ESAF circuit will set the Fire signal to a digital logic "1" level. If the HVFS board receives that signal, then it will turn on the transistor which will dump the energy stored from within the high voltage capacitor to thereby fire the Detonator (see 520). The ESAF board will transmit the ANSI letters, data "g" and "k", to the GCS to notify it that the fuze had fired the Detonator; turned off all the signals to digital logic "0"; and then deactivated. The ESAF circuit also has an accelerometer sensor 210 which can detect if the UAV has impacted the target. If so, then the ESAF circuit sets the logic signal to fire 207 the Detonator (see 520).

In order to deactivate arming, the operator may instead enter ANSI letter, data "g", on the hyper terminal PC for a Disarm command 204. If so, then the ESAF circuit will check if such Disarm command matches the one that is hard coded on the MC software. If the command matches, then the ESAF circuit will transmit ANSI letter, data "k", to the GCS, to notify it that the fuze had turned off all the signals to digital logic "0" level, and deactivated.

UAV tests of the present invention have verified the fuze circuits can function properly to identify and transmit problem occurrences, to fire the detonator, and to disarm/discharge the high voltage capacitor.

While the invention may have been described with reference to certain embodiments, numerous changes, alterations and modifications to the described embodiments are possible without departing from the spirit and scope of the invention as defined in the appended claims, and equivalents thereof.

What is claimed is:

1. An unmanned aerial vehicle (UAV) having a universal smart fuze controlled by a human operator at a ground control station for enabling multiple functions for such unmanned aerial vehicle, said fuze comprising:

a first means for continuously communicating aspects of fuze status back to the human operator at the ground control station;

a second means for measuring flight velocity by noting air speed of the UAV;

a third means for arming an explosives warhead package in the unmanned aerial vehicle;

a fourth means for disarming said explosives warhead package in the unmanned aerial vehicle;

a fifth means for firing said explosives warhead package in the unmanned aerial vehicle; and a sixth means for detonating said explosives warhead package in the unmanned aerial vehicle on impact with a select target.

2. The vehicle of claim 1 wherein, with operator command from the ground control station, said third means becomes operable in response to inputs from said first and second means.

3. The vehicle of claim 1 wherein, with operator command from the ground control station, the first means may be used to verify that the UAV is ready for launch.

4. The vehicle of claim 1 wherein, with operator command from the ground control station, the first means and the second means are used to verify a successful launch.

5. The vehicle of claim 4 wherein upon verification of a successful launch, with operator command from the ground control station, said third means is used to arm the UAV for a later in flight detonation of said explosives warhead package.

6. The vehicle of claim 5 wherein, upon operator command from the ground control station, said third means is used to disarm the UAV from said detonation.

7. The vehicle of claim 5 wherein, upon operator command from the ground control station, said fifth means is used to in flight detonate said explosives warhead package.

8. The vehicle of claim 4 wherein upon verification of a successful launch by the operator, and through operator command from the ground control station, said third means is used to arm the UAV for a later detonation of the explosives warhead package into a select target upon impact therewith.

9. The vehicle of claim 8 wherein upon operator command from the ground control station, said third means is used to disarm the UAV from said detonation.

10. The vehicle of claim 8 wherein, upon successful observation by the operator, and with operator command from the ground control station, said sixth means is used to detonate said explosives warhead package into a select target upon impact therewith.

11. The vehicle of claim 10 wherein the select target is an improvised explosive device (IED).

12. The vehicle of claim 10 wherein the select target is an enemy fortification.

* * * * *